US005171155A

United States Patent [19]

Mendoza

[11] Patent Number: 5,171,155

[45] Date of Patent: Dec. 15, 1992

[54] SAFETY LOCK FOR ELECTRICAL APPLIANCE PLUGS

[76] Inventor: Humberto Mendoza, Km. 3, Carretera aPto., Cortes Apdo 1000, San Pedro Sula, Honduras

[21] Appl. No.: 753,791

[22] Filed: Sep. 3, 1991

[51] Int. Cl.[5] ..... H01R 13/44

[52] U.S. Cl. ..... 439/134; 439/449; 70/360

[58] Field of Search ..... 439/133, 134, 149, 304, 439/449; 70/57, 58, 360

[56] References Cited

U.S. PATENT DOCUMENTS

| | | | |
|---|---|---|---|
| 2,654,073 | 9/1953 | Katz | 439/134 |
| 4,025,140 | 5/1977 | Matys | 439/134 |
| 4,611,477 | 9/1986 | Crites | 70/360 |
| 5,006,960 | 4/1991 | Kallin et al. | 439/449 |

*Primary Examiner*—Paula A. Bradley
*Attorney, Agent, or Firm*—Oltman and Flynn

[57] ABSTRACT

An apparatus to prevent the insertion of the prongs of an electric cord plug into an electric outlet, where at least one of the prongs has a hole through it, includes a casing having ports for receiving the prongs of the plug, a latch within the casing for sliding through the prong hole, a lock connected to the latch such that the lock controls the operation of the latch, and a key for operating the lock. At least one channel may optionally be provided in the casing into which the portion of the cord extending from the locked plug can be laterally fitted. The lock preferably includes a sliding cylinder, a tumbler having a keyhole for receiving a key, rotatably fit within said sliding cylinder, a tube for containing the sliding cylinder, extending into the casing, a spring within the tube for biasing the sliding cylinder to protrude out of the tube and the casing, a bolt mounted on the tumbler which rotates with the tumbler, a slot in the tube through which the bolt can slide axially when the sliding cylinder slides within the tube and radially to permit the bolt to rotate and lock against axial movement. The latch is preferably attached to the sliding cylinder and slides into the prong hole when the sliding cylinder is depressed.

6 Claims, 2 Drawing Sheets

SAFETY LOCK FOR ELECTRICAL APPLIANCE PLUGS

BACKGROUND OF THE INVENTION

1. Field of the Invention

The present invention relates generally to the field of home safety devices for children, and more specifically to a locking device which can be placed over the male terminals of an electric appliance cord plug to prevent children and others from inserting the terminals into an outlet.

2. Description of the Prior Art

There have long been devices for preventing the unauthorized use of appliances, in the form of locks for their electric cord plugs. Such devices have chiefly been intended to protect children. The existing designs present various disadvantages including awkwardness, bulk, needless complexity, needless expense and the potential for damaging the plug terminals.

Rockman, U.S. Pat. No. 2,643,787, issued on Jun. 30, 1953, discloses a lockable container for an electrical plug to prevent its unauthorized use. The plug fits into an open side of a small box and the cord fits into a slot in an adjacent side. Then the box slides into a sleeve which covers most of the open side of the box. The box is removably locked into the sleeve with a conventional trunk-type lock. A problem with Rockman is that the device has more than one separate part, which multiples the chances of loosing an essential part. Also, the need to manipulate the separate parts makes the use more complicated and frustrating where speed is needed. Finally, since the plug end is free to rattle inside the box, the terminals are potentially subject to damage.

Laff, U.S. Pat. No. 3,524,029, issued on Aug. 11, 1970, teaches a chamber for containing a cord plug, the chamber having an interior socket for receiving the plug terminals. Wiring from the interior socket passes through a switch, which is operated by a key from outside the chamber, and the wiring then exits the chamber and ends in a plug with terminals. Thus, to deliver power to the appliance or other item, one must insert the device plug into an electric wall socket and insert and turn the key. A problem with Laff is that children can still play with exposed device terminals, inserting them into a wall socket, and possibly shocking themselves. An since the device remains attached to the cord even when power is drawn, it can be cumbersome. Laff is also a relatively complex and expensive structure for the purpose intended.

Sherman, U.S. Pat. No. 4,167,658, issued on Sep. 11, 1979, is essentially a small, updated version of Laff. Sherman is a casing with holes for receiving plug terminals. The terminals are locked into the casing holes, and a second set of terminals on the device itself plug into a wall socket. A switch on the casing operated by a key regulates the flow of current into the plug through the device. Since Sherman remains attached to the plug even when in use, it is cumbersome like Laff.

Pfenning, U.S. Pat. No. 4,488,764, issued on Dec. 18, 1984, discloses a lockable container similar to Rockman for enclosing a plug. Rather than having a box slide into a sleeve, the Pfenning container has a removable top with a key lock. Like Rockman, the need to manipulate more than one part, i.e., the box and separate locking top, makes Pfenning frustrating where speed is required. Again, the chances of loosing one of the parts is multiplied. Finally, since the plug is free to rattle in the box, the terminals may be damaged.

Goebel, U.S. Pat. No. 4,705,335, issued on Nov. 10, 1987, is still another lockable container for enclosing electric cord plugs. The primary difference between Goebel and Pfenning is that Goebel is designed to retain a plurality of plugs. Goebel has a one-piece construction, but otherwise has the disadvantages of Pfenning. An additional disadvantage is that Goebel is relatively cumbersome.

Sieverman, U.S. Pat. No. 4,812,131, issued on Mar. 14, 1989, teaches a variation of the terminal receiving lock, wherein the terminals once again fit into holes in the casing of the device. A strap with an axial series of perforations fits through a slot in the casing and claw-like arms at the end of the strap fit around the body of the plug. A key-operated locking device causes a detent to slide through one of the perforations in the strap and thus locks the plug into the device A problem with Sieverman is that, like Rockman, it has two separate parts, the strap and the casing, to manipulate when attaching or removing it. Also, the claw-like arms could be pried off the plug relatively easily, thereby freeing it for unauthorized use.

Kershaw, U.S. Pat. No. 4,865,557, issued on Sep. 12, 1989, discloses still another container for enclosing the plug of an electric cord. This container is very similar to that of Pfenning except that barbed twin posts snap through holes in the cover. The device must be destroyed to remove it from the plug. A problem with Kershaw, in addition to those of Pfenning, is that it can be used only once. Thus, Kershaw is poorly suited for frequently used appliances.

It is thus an object of the present invention to provide a plug locking device wherein its elements ar inseparably combined into a single piece and which surrounds and protects each terminal of the plug.

It is another object of the present invention to provide such a device which can be securely attached and easily removed with a key to permit reuse.

It is another object of the present invention to provide such a device which permits the user to avoid contact with the current-carrying terminals of a wall socket.

It is still another object of the present invention to provide such a device which is compact and which does not remain attached to the plug or cord when not in use.

It is finally an object of the present invention to provide such a device which is durable and inexpensive.

SUMMARY OF THE INVENTION

The present invention accomplishes the above-stated objectives, as well as others, as may be determined by a fair reading and interpretation of the entire specification.

An apparatus to prevent the insertion of the prongs of an electric cord plug into an electric outlet is provided, where at least one of the prongs has a hole through it, and includes a casing having ports for receiving the prongs of the plug, a latch within the casing for sliding through the prong hole, a lock connected to the latch such that the lock controls the operation of the latch, and a key for operating the lock. There may be three ports in the casing for receiving the prongs of a three prong or two prong plug. Alternatively, there may be two ports in the casing for receiving the prongs of a two prong plug. At least one channel may optionally be provided in the casing into which the portion of the cord extending from the locked plug can be laterally fitted. Alternatively, at least two channels having different widths may be provided in the casing to accommodate cords of more than one diameter. The lock preferably includes a sliding cylinder, a tumbler having a keyhole for receiving a key, rotatably fit within said sliding cylinder, a tube for containing the sliding cylinder, extending into the casing, a spring within the tube for biasing the sliding cylinder to protrude out of the tube and the casing, a bolt mounted on the tumbler which rotates with the tumbler, a slot in the tube through which the bolt can slide axially when the sliding cylinder slides within the tube and radially to permit the bolt to rotate and lock against axial movement. The latch is preferably attached to sliding cylinder and slides into the prong hole when the sliding cylinder is depressed.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
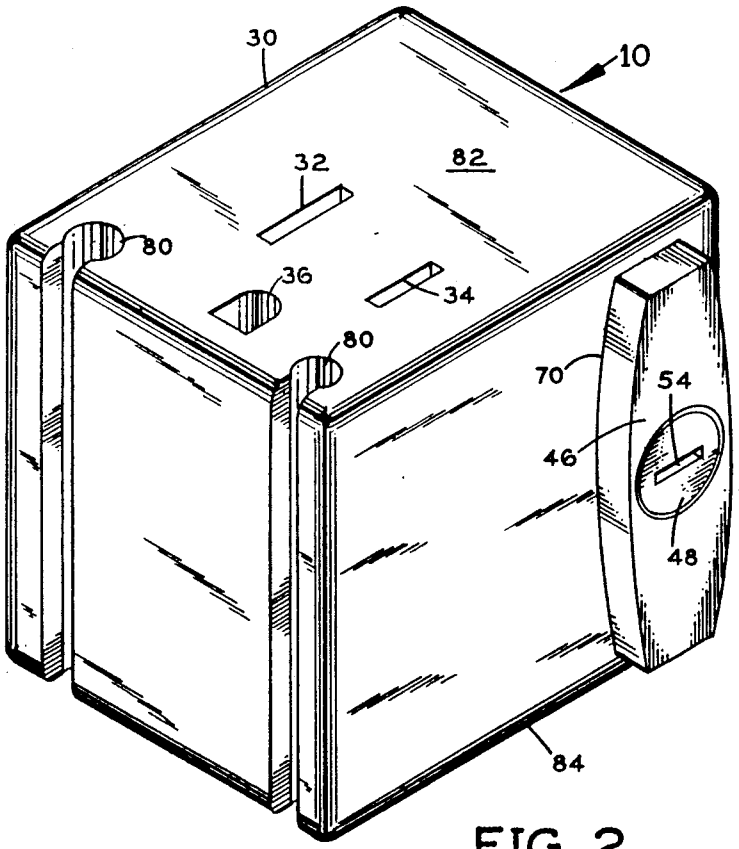
FIG. 2 is perspective view of the preferred embodiment without the plug and cord.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
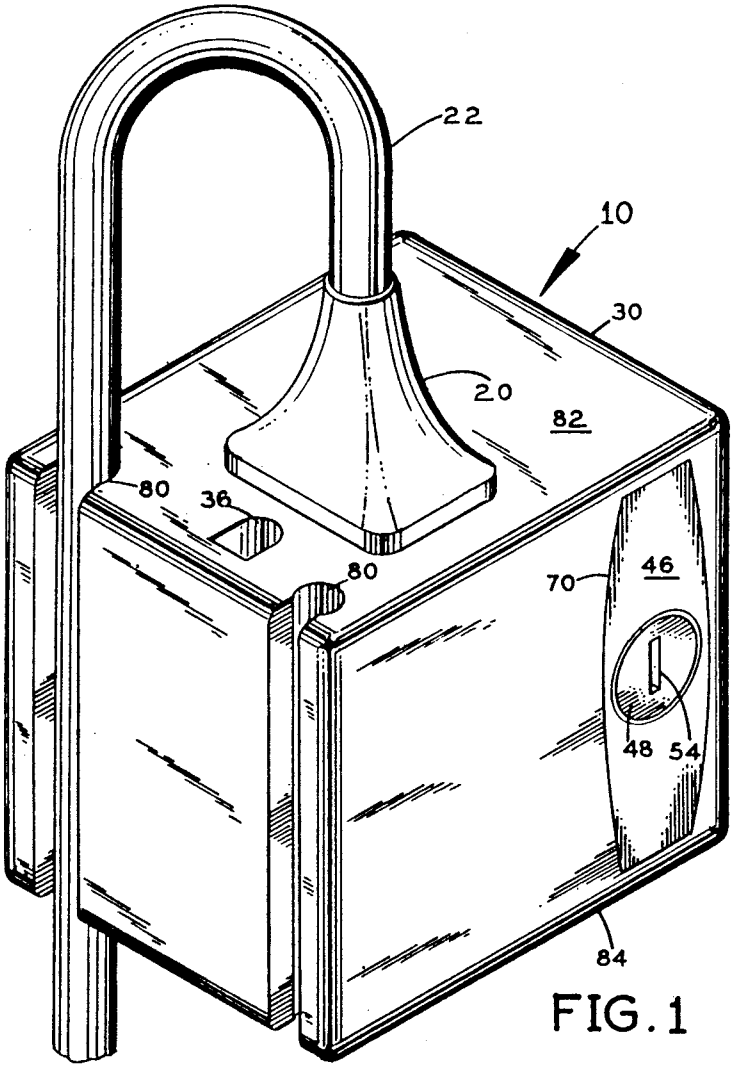
FIG. 1 is a perspective view of the preferred embodiment of the inventive device, with a plug and its cord fitted into it.
Figure 3:
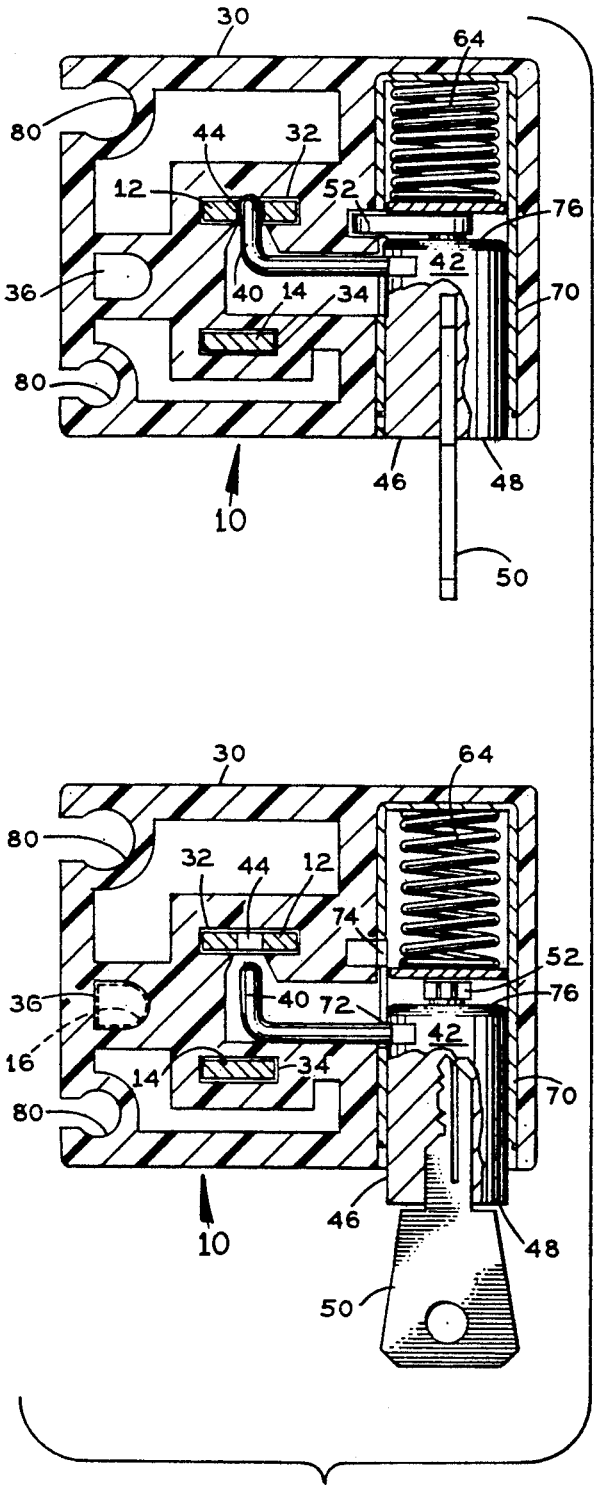
FIG. 3 is a two step illustration of the locking of the device, with a first cross-sectional view revealing the key turned into the locking position, and a second cross-sectional view revealing the key turned the unlocking position.

Referring to FIGS. 1 and 2, a safety lock 10 for shielding the male terminals, hereinafter prongs 12, 14 and 16, of a plug 20 of an electric cord 22 is disclosed. Safety lock 10 includes an essentially cubical casing 30 having three terminal ports 32, 34 and 36 for receiving prongs 12, 14 and 16 of plug 20, respectively. An L-shaped latch member 40 is mounted on a slide lock cylinder 42, extending into casing 30 and having a protruding end 46. Depressing protruding end 46 causes latch member 40 to slide through a hole 44 in a prong, such as prong 12, locking prong 12 into port 32. See FIG. 3.

A key-operated tumbler 48 is rotatably mounted within cylinder 42. The rotation of tumbler 48 with a key 50 operates a bolt 52 which locks cylinder 48 into the depressed, locked position. Key 50 fits into an axial keyhole 54 in tumbler 48, and tumbler 48 permits rotation only with the matching key 50.

Prongs 12, 14 and 16 on modern plugs 20 are of different cross-sectional shapes and serve different purposes. On a two-prong plug, prongs 12 and 14 are flat, and the ground prong 12 is wider than the current-carrying prong 14, so that the prongs cannot be fitted into an outlet in reverse. On a three prong plug 20, the third prong 16 is also a ground terminal, and it is essentially round in cross-section, with a narrow flat side. The hole 44 which receives latch member 40 is typically created during prong manufacture. Latch member 40 is positioned to slide into port 32 and thus into hole 44 in prong 12.

Figure 4:
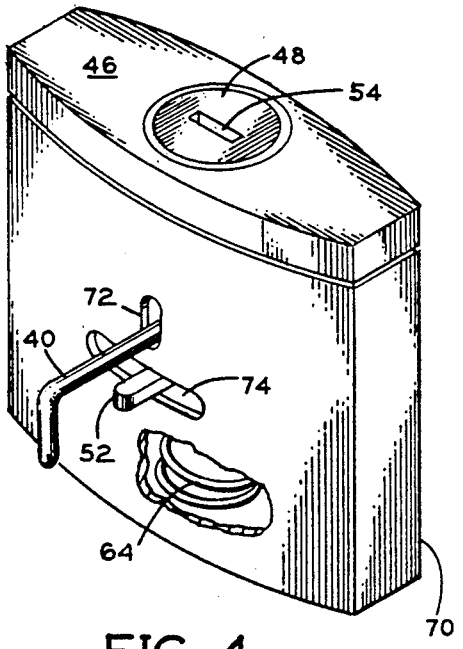
FIG. 4 is a perspective view of the tube, sliding cylinder and bolt.

Slide lock cylinder 42 may be essentially rectangular in cross-section, as shown in FIGS. 1 and 4. Slide lock cylinder 42 is biased with a spring 64 contained within a guide tube 70, which extends into casing 30. See FIG. 4. Tube 70 has two slots 72 and 74. Latch member 40 fits through and is guided by axial slot 72. Latch member 40 moves in and out of port 32 with the depression and release, respectively, of cylinder 42. Bolt 52 projects perpendicularly from the bolt end 76 of tumbler 48. Bolt 52 rotates into slot 74. Slot 74 extends perpendicular to the axis of tumbler 48, to permit bolt 52 to rotate with tumbler 48 when tumbler 48 is depressed and turned with key 50. When depressed, protruding end 46 of cylinder 42 is flush with the outer surface of casing 30. The rotation of bolt 52 into slot 74 causes bolt 52 to hold tumbler 48, and thus cylinder 42, in the depressed position. The rotation of bolt 52 out of slot 74 releases cylinder 42. The release of cylinder 42 permits spring 64 to push cylinder 42 outward, and thus slide latch member 40 out of port 32 and prong 12. Spring 64 is a standard type of coil spring which resists compression.

An optional channel 80 along a face of casing 30 is provided to receive the cord 22 extending from plug 20. Channel 80 extends from the terminal face 82 of casing 30 to the opposite face 84. The securing of cord 22 in channel 80 prevents any tension in cord 22 from being carried directly by the mechanism of safety lock 10. Several channels 80 may be provided having differing widths to accommodate cords of various diameters. Casing 30 is preferably formed of high-density plastic, which makes the sides of channels 80 resilient to grip cords 22.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus to prevent the insertion of the prongs of an electric cord plug into an electric outlet, at least one of said prongs having a hole through it, comprising:
   - a casing having ports for receiving the prongs of the plug,
   - a latch within the casing for sliding through said hole,
   - a lock connected to said latch such that the lock controls the operation of said latch,
   - a key for operating said lock, and wherein at least one channel is provided in the casing into which the portion of the cord extending from the locked plug can be laterally fitted.

2. An apparatus as in claim 1, wherein there are three ports in the casing for receiving the prongs of a three prong plug.

3. An apparatus as in claim 1, wherein there are two ports in the casing for receiving the prongs of a two prong plug.

4. An apparatus as in claim 1, wherein at least two channels with different widths are provided in the casing to accommodate cords of more than one diameter.

5. An apparatus to prevent the insertion of the prongs of an electric cord plug into an electric outlet, at least one of said prongs having a hole through it, comprising:

a casing having ports for receiving the prongs of the plug, a latch within the casing for sliding through said hole, a lock connected to said latch such that the lock controls the operation of said latch, a key for operating said lock, a sliding cylinder, a tumbler having means for receiving a key rotatably fit within said sliding cylinder, a tube for containing the sliding cylinder extending into the casing, spring means within said tube for biasing the sliding cylinder to protrude out of said tube and said casing, a bolt mounted on said tumbler which rotates with the tumbler, a slot in said tube through which said bolt can slide axially when the sliding cylinder slides within the tube and radially to permit the bolt to rotate and lock against axial movement.

6. An apparatus as in claim 5, wherein the latch is attached to the sliding cylinder and slides into the hole when the sliding cylinder is depressed.

* * * * *